US007096965B2

(12) United States Patent
Ozment

(10) Patent No.: US 7,096,965 B2
(45) Date of Patent: Aug. 29, 2006

(54) METHOD AND APPARATUS FOR FIGHTING FIRES IN CONFINED AREAS

(76) Inventor: Alden Ozment, 116 Hunter Creek Dr., Longview, TX (US) 75605

( * ) Notice: Subject to any disclaimer, the term of this patent is extended or adjusted under 35 U.S.C. 154(b) by 158 days.

(21) Appl. No.: 10/620,882

(22) Filed: Jul. 16, 2003

(65) Prior Publication Data

US 2004/0016552 A1 Jan. 29, 2004

Related U.S. Application Data

(60) Provisional application No. 60/398,501, filed on Jul. 25, 2002.

(51) Int. Cl.
*A62C 2/00* (2006.01)

(52) U.S. Cl. ..... 169/44; 169/15; 169/47; 169/64; 169/70; 239/8; 239/310; 239/318; 239/422; 239/427; 239/428

(58) Field of Classification Search ..... 169/14, 169/15, 44, 46, 47, 64, 66, 68, 70; 239/8, 239/310, 317, 318, 419.3, 422, 424, 427, 239/427.3, 427.5, 428; 252/2, 3, 8.05
See application file for complete search history.

(56) References Cited

U.S. PATENT DOCUMENTS

| | | | | |
|---|---|---|---|---|
| 3,172,477 | A * | 3/1965 | Grisdale et al. | 169/64 |
| 3,272,263 | A * | 9/1966 | Jamison | 169/15 |
| 3,469,405 | A | 9/1969 | Reinhold | |
| 3,500,934 | A | 3/1970 | Magnuson | |
| 3,692,117 | A | 9/1972 | Wright | |
| 4,641,711 | A * | 2/1987 | Terry | 169/44 |
| 5,464,065 | A | 11/1995 | Kaylor | |
| 5,497,833 | A | 3/1996 | Kaylor | |

(Continued)

OTHER PUBLICATIONS

Lynn Glover, Burning Beneath the Surface; Tribune Review, May 3, 1998, downloaded May 3, 1998, downloaded May 31, 2002 at http://www.penweb.org/issues/mining/tribrev/swfires.html.

*Primary Examiner*—Steven J. Ganey
(74) *Attorney, Agent, or Firm*—Stites & Harbison PLLC; John E. Vanderburgh

(57) ABSTRACT

The method of the invention comprises the steps of proportioning a foam concentrate into a non-flammable liquid to form a foam concentrate/liquid mixture and creating a flowing stream of the foam concentrate/liquid mixture. Nitrogen is introduced to the stream of the foam/liquid mixture to initiate the formation of a nitrogen expanded foam fire suppressant. The flowing stream carrying the initially nitrogen expanded foam is dispensed, which completes the full expansion of the nitrogen expanded foam fire suppressant, into the confined area involved in fire thereby to smother the fire and to substantially close off contact between combustible material involved in fire and the ambient atmosphere substantially reducing the danger of explosion or flash fires. The apparatus of the invention is adapted for expanding and dispensing foam and comprises a housing defining an interior through which extend a discharge line. The ends of the housing are closed about the ends of the discharge line and the ends of the discharge line extend beyond the ends of the housing to define a connector at one end for receiving a stream of foam concentrate/liquid and at the opposite end to define the foam dispensing end of the apparatus. A portion of the discharge line in the housing defines an eductor for introduction of the expanding gas into the stream of foam concentrate/liquid flowing through the discharge line.

14 Claims, 1 Drawing Sheet

U.S. PATENT DOCUMENTS 5,623,995 A * 4/1997 Smagac ..... 169/15
5,632,338 A * 5/1997 Hunter ..... 169/15
5,683,294 A 11/1997 Maines
5,799,735 A * 9/1998 Sundholm ..... 169/14
5,853,050 A 12/1998 Kittle
6,112,819 A 9/2000 Henry
6,155,351 A 12/2000 Breedlove et al.
6,267,183 B1 7/2001 Smagac

* cited by examiner

METHOD AND APPARATUS FOR FIGHTING FIRES IN CONFINED AREAS

This application claims the benefit of the filing date of provisional application Ser. No. 60/398,501, filed Jul. 25, 2002, entitled METHOD AND APPARATUS FOR FIGHTING FIRES IN CONFINED AREAS, which is incorporated by reference herein.

BACKGROUND OF THE INVENTION

This invention relates to fire-fighting and more particularly to method and apparatus for fighting fires in confined areas.

BACKGROUND OF THE INVENTION

Fires in confined areas can be extremely difficult to contain much less to extinguish due to a number of factors including, but not limited to, heat buildup, the ready availability of fuel and the presence of toxic gases, all of which make delivery of fire suppressant material difficult. Confined areas include locations such as storage tanks and underground mines as well as below surface fires, such as landfill fires for example. These sites can combine the worst dangers to property and life in that the hot combustion gases are confined and can be prone to explosion and can provide additional fuel to the fire. In addition the combustion gases normally contain toxic levels of carbon monoxide gas, methane gas and other toxic substances. In coal mine fires, for example, the abundance of fuel in a confined, poorly accessible area practically guarantees that the fire will burn for extremely long periods of time with resultant loss of production great property loss. Many coal mines must be abandoned in the event of a fire because of the great difficulty in extinguishing the fire. For example the Jonesville coal mine fire started more than 30 years ago and is still burning. The town of Centrala, Pa. has been abandoned because of a coal mine fire that began in 1961 because of the seeping of noxious gases to the surface. The residents of the City of Youngstown have seen their property values drop to near zero due to the Percy mine fire in Fayette County, Pa. that has been burning for more than 30 years and they are concerned that they will lose their homes.

Although not prone to the extremely long burning periods encountered in coal mine fires, other fire locations such as underground fuel storage tanks, above ground chemical storage tanks and the like present similar problems. It is difficult to apply fire suppressant material to the fire because of the danger to the firefighters from explosion, heat buildup and toxic gases.

SUMMARY OF THE INVENTION

The present invention provides an effective method and apparatus for fighting fires in confined areas. While the invention will be described hereinafter in connection with coal mine fires, it should be understood that the method and apparatus described herein are effective in fighting other types of fires in confined areas, such as for example other types of below surface fires, storage tank fires and the like.

The present invention relates to a method and apparatus for extinguishing a fire in a confined, normally poorly ventilated area. The method generally comprises the steps of proportioning a foam concentrate into a non-flammable liquid to form a foam concentrate/liquid mixture and creating a flowing stream of the foam concentrate/liquid mixture.

Nitrogen is introduced to the stream of the foam/liquid mixture to initiate the formation of a nitrogen expanded foam fire suppressant. The flowing stream carrying the initially nitrogen expanded foam is dispensed, which completes the full expansion of the nitrogen expanded foam fire suppressant, into the confined area involved in fire thereby to smother the fire and to substantially close off contact between combustible material involved in fire and the ambient atmosphere substantially reducing the danger of explosion or flash fires.

In one embodiment the invention comprises a method for extinguishing a fire in a mine comprising the steps of: (i) forming a seal between a portion of the confined area involved in fire and uninvolved portions of the confined area; (ii) providing at least one foam ingress point to said portion of the confined area involved in fire; (iii) proportioning a foam concentrate into a non-flammable liquid to form a foam concentrate/liquid mixture; (iv) forming a foam fire suppressant by introducing gas consisting essentially of nitrogen under pressure to said foam concentrate/liquid mixture to expand said foam concentrate in said non-flammable liquid; and (v) introducing said expanded foam fire suppressant through said foam ingress point while maintaining a seal between said portion of the confined area involved in fire and said uninvolved portion of the confined area.

Apparatus of the present invention comprises a housing defining an interior having end walls, a discharge line extending through said housing, said discharge line having a first open end and a second open end, said end walls being closed about said discharge line, said first and second ends of said discharge line extending beyond said end walls of said housing to define a connector at said first end for receiving a stream of foam concentrate/liquid and said second end defining a foam dispensing end of said apparatus, a portion of said discharge line in said housing being provided with at least one opening to define an eductor for introduction of an expanding gas into said stream of said foam concentrate/liquid flowing through the discharge line.

The method and apparatus of the instant invention eliminates the problems associated with conventional air expanded fire suppressant foam that provides fire-stimulating oxygen which essentially defeats the purpose and function of the fire-fighting foam. The present invention allows for the dispensing of the nitrogen expanded foam to be accomplished without the necessity of personnel being exposed to toxic combustion by-products. In addition, however, the apparatus of the invention is light weight and highly portable.

DESCRIPTION OF THE PREFERRED EMBODIMENT OF THE INVENTION

Figure 1:
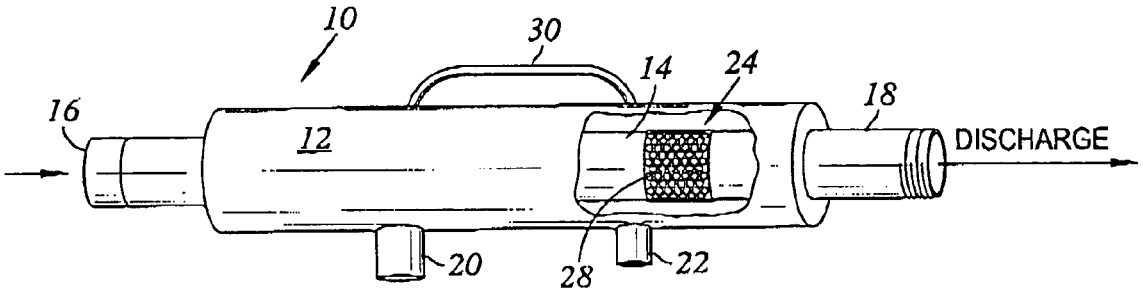
FIG. 1 is a side elevation of the apparatus for expanding and discharging foam in the method of the invention having a portion of its outer housing cut away to show the aspirator portion.

As used herein the term "confined area" means an area of combustible material that is located at a site having normally limited ventilation and limited access in which combustion by-products can be confined and can pose a threat to personnel attempting to extinguish a fire at the site as well as providing additional combustible material to feed the fire and make extinguishing of such a fire, other than letting the fire burn itself out, even more difficult if not impossible.

Fires in such confined areas are normally isolated from the surface, such as for example mine fires, landfill fires and the like or are in enclosures such as storage tanks that likewise isolate the fire from the surface and provide a containment area for dangerous combustion by-products.

In accordance with the invention described herein, a method and apparatus for fighting fires in coal mines and other confined areas is described using high-expansion foam that is expanded with nitrogen. Commercially available foam concentrates are utilized. Apparatus for discharging the foam is described.

As mentioned, the present invention is applicable to fires in various confined areas, however, for purposes of description the invention will be described in connection with mine fires and more particularly with fires that occur in coal mines. It will be apparent, however, that the principles described in connection with fighting a mine fire are applicable to fires occurring at other confined area venues.

Fighting a fire in a mine in general comprises the steps of (i) creating a seal between the portion of the confined area involved in the fire and the uninvolved portion of the confined area; and (ii) introducing a fire suppressant or allowing the fire to burn itself out while maintaining the involved area sealed. It is preferred but not essential to draw out the atmosphere from the involved area after it has been sealed. In many cases, however, removing the atmosphere from the involved area is not possible or is not practicable. In addition the involved area is often flooded with water to attempt to extinguish the fire and generally reduce the temperature at the involved area.

Permanent and temporary seals or brattices are well known and have been long used in the mining field for sealing portions of a passage or shaft in a mine. Brattices of varying designs are used to for ventilation control and for emergencies, such as in the event of a fire. For the purposes of the present invention the brattice must be fire proof and provide a suitable opening to permit the distribution of foam to the area involved in the fire. A discussion of several different brattice designs is found in U.S. Pat. No. 5,683,294, granted Nov. 4, 1997 to Teddy Maines.

Practicing the conventional fire-fighting techniques normally require the involved area to out of production for many weeks or months before it is safe to allow personnel back into the affected area of the mine. In some instances the entire mine is closed for extended periods of time and in some cases even permanently.

In mine fires where the involved area is sealed, it is preferred that the atmosphere in the sealed area is drawn out so as to reduce as much as possible the oxygen in the sealed area to limit or slow the progress of the fire. This may followed by an attempt to flood the area with water. In the fires at Centralia, Percy mine and Jones mine, described above, these procedures alone obviously did not work with the resultant loss to the community and to the mine operators.

Water is not the most effective fire suppressant or extinguishing material for use in most confined area fires, particularly in fighting coal mine fires. In many cases the water does not reach the fire because of dips and fissures in the mine shaft that in effect pool, retain or otherwise divert the water and prevent it from reaching the fire. In addition, the contact time of water that does reach the fire is short and the water evaporates and does not thoroughly penetrate and/or wet the fuel supporting the fire.

Conventional foam has been applied in attempting to extinguish coal mine fires. This foam is expanded with air that, of course, contains a substantial concentration of oxygen thus adding a highly combustible substance to the fire that becomes available to support combustion as the foam breaks down. In the book, Mine Fires by Donald W. Mitchell, Intertec Publishing, Inc., 29 North Wacker Drive, Chicago, Ill. 60606, in a chapter entitled *High-Expansion Foam*, the author discusses the use of foam in mine fires and introduces the chapter relating to the use of foam (p 175) with the statement; "[H]igh expansion foams have not yet extinguished a real mine fire."

The method of the invention employs a high expansion foam concentrate that is proportioned in water and the foam is expanded with a gas consisting essentially of nitrogen. A proportioning device is utilized for mixing the concentrate and the water and the gas is led into the foam concentrate/water mixture under pressure for expanding the foam. A dispensing device may be employed to direct the expanded foam to the area involved in fire.

Commercially available high expansion foam concentrates are used in producing the fire suppressant foam. Class A foam concentrates are preferred both for their ability to isolate the fuel and because the proportioning of the concentrate and water is not as critical as for Class B foams. Such concentrates consist primarily of a surfactant solubilized in a non-flammable solvent and may further include wetting agents to aid in penetration of the fuel. The foam concentrate is proportioned with water in percentages ranging from about 0.1% by volume to about 1% by volume depending on the hardness of the water. In addition the water is also used as the primary propellant to distribute the foam.

The choice of proportioning method is not critical. In some cases it may be desirable to premix the foam concentrate and water in a suitable container. Such proportioning method may be preferred in small fires where foam volume will be relatively small. This method also lends itself for use in portable equipment. Venturi type or line proportioning devices are suitable for both portable systems and, for systems requiring a high volume of foam to be produced, are best suited in situations where water pressure is essentially constant in order to insure proper proportioning of water and concentrate and delivery of foam at a constant rate. Other types of proportioners such as "around the pump" proportioners are well suited for delivery of large quantities of foam at a constant rate and as such are highly suited for disbursement of high expansion foam in fighting mine fires.

Conventionally air is used as the gas in forming high expansion foams. However, in view of the need to reduce the oxygen content in the mine at the area involved in the fire, contributing to the oxygen content in the sealed area by the expanded foam is undesirable. Accordingly, a gas consisting essentially of nitrogen is employed as the expanding gas. The nitrogen gas is proportioned into the water/foam concentrate mixture in a ratio of about 2 gal/min concentrate to 1 cfm of nitrogen and several hundred cubic feet of foam can be produced from one gallon of the water/concentrate mixture. The flow rate of the water/concentrate mixture and thus the discharge in cubic feet per minute of foam is dependent to a large extent on the available supply of nitrogen and water at the site of the fire.

Figure 2:
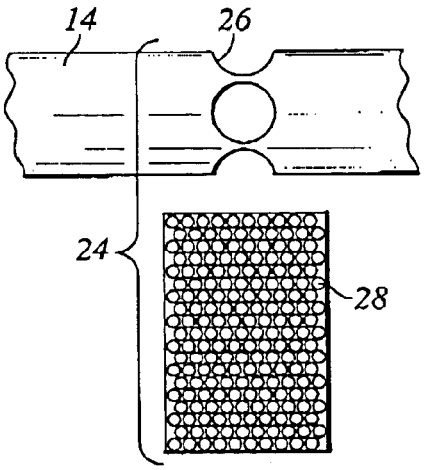
FIG. 2 is an exploded view of the aspirator of the apparatus of FIG. 1 in enlarged scale.

The foam is expanded and dispensed through diffuser/dispenser apparatus that functions to introduce pressurized nitrogen into the water/foam concentrate stream to expand the foam and to dispense the expanded foam. In accordance with one aspect of the invention as shown in FIG. 1, the diffuser/dispenser apparatus, shown generally as 10, comprises an outer cylindrical casing 12 through the interior of which extends a discharge line 14 parallel with the axis of the outer casing. The ends of the outer casing 12 are closed around the discharge line 14. One end of the discharge line 14 extends beyond the outer casing 12 to define an intake 16 that communicates with a source of the water/foam concentrate mixture. The opposite end of the discharge line 14 extends beyond the outer casing at its opposite end to define a discharge 18 for dispensing the highly expanded foam. A nitrogen intake nipple 20 communicates through the outer casing 12 for leading pressurized nitrogen into the outer casing and a drain nipple 22 communicates with the interior of the outer casing for draining fluid from its interior. A portion of the discharge line 14 defines an eductor 24 for entraining the nitrogen gas in the water/foam concentrate stream flowing through the discharge line. As more clearly shown in FIG. 2, the eductor 24 is formed by four openings 26 in the wall of the discharge line. Each of the openings 26 is spaced 90 degrees apart from the adjacent openings. A metal screen 28 is disposed about the discharge line 12 to overlie the openings 26. For ease of handling the diffuser 10, a handle 30 is provided.

In operation, water and foam concentrate is mixed as the water flows through a conventional eductor. The water/foam concentrate stream flows into the intake 16 of the diffuser 10 while nitrogen is led into the interior of the outer casing 12 through the nipple 20 that communicates with a source of pressurized gas consisting essentially of nitrogen. The flow of the liquid stream past the eductor 24 lowers the pressure in the interior of the outer casing 12 that assists in drawing the nitrogen into the flowing stream. The introduction of the nitrogen initiates the full expansion of the foam as it leaves the discharge 18 of the discharge line 14. The flow of the liquid stream acts to propel the foam from the diffuser 10. Liquid that passes out of the discharge line 14 through the openings 24 is drained from the interior of the outer casing 12 through the drain nipple 22.

Although it is not shown, a diffuser nozzle can be affixed to the end of the discharge 18 by suitable means such as by the provision of external threads on the end of the discharge that threadibly engage corresponding internal threads in the diffuser nozzle. The diffuser nozzle can be of any conventional design and although the use of such a nozzle is not required it does serve to enhance the expansion of the foam blanket.

The following example is intended for illustration purposes only and should not be construed as limiting the invention as defined herein.

EXAMPLE

The following is an example of the use of the method and apparatus of the present invention to extinguish a fire in an existing underground coal mine.

A roof fall behind two seals identified as Seals 6 and 8 on Level 1 of an underground coal mine was the probable cause of a fire started by spontaneous combustion. The fall provided the fuel and created the atmosphere that was conducive to spontaneous combustion.

A rise in carbon monoxide concentrations at Seal No. 6 was found during a routine inspection. Once it was determined that the elevated carbon monoxide was not due to normal activities, all personnel, with the exception of those individuals allowed to repair seals and to collect samples were evacuated from the mine. For purposes of this example the sequence of events begins at day one with the evacuation.

By day four the site of the fire was located behind Seal No. 6. Installation of water injection pipes to Seal No. 6, as well as to Seal No. 8, began on day four. Additional seals were constructed adjacent to Seal Nos. 6 and 8 to form an airlock between the existing seals and the new seals. On day eight of the fire, dry chemical fire extinguishers were discharged behind the original Seal No. 6 and Seal No. 8. By day nine, the installation of the water pipes was completed and the area behind Seals 6 and 8 was flooded. Although further sampling indicated that the level of carbon monoxide and hydrogen concentration had reduced somewhat, the concentration of these gases remained at a dangerous level indicating that the fire was not extinguished.

On day fourteen of the fire, nitrogen expanded foam injection was started. The existing water pipes through Seals 6 and 8 were employed to provide access for the nitrogen foam into the area behind the seals.

The foam concentrate used was "High Expansion Concentrate, Type 2.0 AE35 for high expansion generators" manufactured by National Mine Service Company. The foam was generated and dispensed using the diffuser described above and illustrated in FIGS. 1 and 2.

Nitrogen used to expand the foam was generated on the surface using a Weatherford Underbalanced Services nitrogen membrane filtration unit. Two screw-type compressors supplied air to the nitrogen membrane filtration unit. The generated gas consisting essentially of nitrogen was delivered to the diffuser in the mine through an existing six-inch steel water discharge pipe.

The nitrogen generator was run for forty-five minutes after which nitrogen was pumped through the lines to the diffuser nitrogen hose to purge the lines of oxygen. Once purged, the diffuser nitrogen hose was connected to the nitrogen intake nipple of the diffuser. A water line attached to the intake of the diffuser was in communication with the pump for providing the water at the desired pressure and flow rate. The foam concentrate was introduced into the waterline upstream of the diffuser to form a water/foam concentrate mixture. Nitrogen pressure to the diffuser was maintained at a level of about 100 psi while the water pressure was maintained at about 90 psi. At all times, the nitrogen pressure was maintained at a level above that of the water. Prior to injection of the foam, a sample foam was generated and the flow rate of the water/foam concentrate mixture was adjusted until foam having the consistency of shaving cream was produced.

Pressure was equalized behind Seals 6 and 8 and foam injection was initiated. Foam injection was monitored through existing monitoring pipes in the seals. Foam injection began on the evening of day fourteen and continued all night and all the day of day fifteen. Toward the end of day fifteen 142,000 cubic feet of foam had been injected into the cavity behind Seal No. 6. Based on gas sampling results on the evening of day fifteen, carbon monoxide and hydrogen levels were essentially normal indicating that the fire was extinguished. On day sixteen gas sampling concentrations had returned essentially to normal and normal operations in the mine were resumed. However, foam injection levels were maintained for several more days to make absolutely certain that the fire had been extinguished.

Using the method of the present invention, the operators were able to extinguish the fire in less than 48 hours. Normal mining operations were resumed in less than two days after the beginning of foam injection.

As indicated above, under ground mine fires as well as other types of fires in confined spaces are difficult to extinguish and can continue to burn for periods of weeks, months and indeed, even years. Once a fire starts in an underground mine, for example, it is often the case that the mine has to be abandoned. In accordance with the present invention there has been provided a means for extinguishing underground mine fires quickly so that normal mining operations can be resumed with a minimum of lost time.

While the invention has described above in connection with a coal mine fire, it will be understood that the method and apparatus of the invention is highly suited for extinguishing fire in other types of confined spaces. Thus, for example, landfill fires can be difficult to extinguish and can burn under the landfill with the generation of noxious pollutants. It is within the scope of this invention to insert a pipe or otherwise form an access path to the site of the fire. The nitrogen expanded foam can then be generated as described above either from the surface and pushed through the pipe or access path to the site of the fire or the diffuser can be inserted into the access path to bring it closer to the fire so that the travel of the foam is thus shortened.

As will be understood by those skilled in the art various arrangements that lie within the spirit and scope of the invention, other than those described in detail in this specification will occur to those persons skilled in the art. It is therefore to be understood that the invention is to be limited only by the claims adhere to.

I claim:

1. A method for extinguishing a fire in a mine shaft comprising the steps of:

a. providing at least one ingress point to said an area of said mine shaft involved in fire;

b. proportioning a foam concentrate into a stream of non-flammable liquid to form a stream of foam concentrate/liquid mixture;

c. introducing a gas comprising nitrogen under pressure to said stream of foam concentrate/liquid mixture by a diffuser/dispenser apparatus to expand said foam concentrate in said stream of non-flammable liquid to form a stream of foam fire suppressant; and d. directing said stream containing an expanded foam fire suppressant through said at least one ingress point.

2. The method of claim 1 further including the step of flooding said area of said mine shaft involved in the fire with water prior to directing said stream containing said expanded foam fire suppressant.

3. The method of claim 1 wherein said gas is proportioned to said stream of water/foam concentrate mixture in a ratio of about 2 gallons per minute of said stream to 1 cfm of said gas.

4. A method for extinguishing a fire in a poorly ventilated area comprising proportioning a foam concentrate into a non-flammable liquid to form a foam concentrate/liquid mixture, creating a flowing stream of said foam concentrate/liquid mixture, said flowing stream being maintained at a pressure of at least 90 psi, introducing a gas consisting essentially of nitrogen under pressure of at least 100 psi to said stream of said foam/liquid mixture to form a nitrogen expanded foam fire suppressant, dispensing said nitrogen expanded foam fire suppressant into said poorly ventilated area involved in fire thereby to substantially close off contact between combustible material involved in fire and the ambient atmosphere.

5. The method of claim 4 wherein said non-flammable liquid is water.

6. The method of claim 5 wherein the concentration of said foam concentrate in water comprises between about 0.1% to about 1.0%.

7. Apparatus for expanding and dispensing a fire suppressant foam comprising:

a. an outer cylindrical casing having end walls defining an interior;

b. an open ended discharge tube in said interior of said casing, an open end thereof extends through each said end wall of said casing, one open end of said discharge tube communicates with a source of a water/foam concentrate mixture, an eductor provided in said discharge tube communicates between said discharge tube and said interior of said casing, a gas intake nipple communicates with said interior of said casing and with a source of pressurized gas for introduction of gas to be drawn into said water/foam concentrate mixture by said eductor to form expanded foam and the opposite open end of said discharge tube defines an egress for dispensing expanded foam.

8. The apparatus of claim 7 wherein said eductor comprises openings in the wall of said discharge tube, each said opening spaced apart from adjacent openings, a screen disposed on said discharge tube to overlie said openings.

9. A method for extinguishing a fire in a mine shaft comprising the steps of forming a seal between an area of said mine shaft involved in fire and uninvolved areas of said mine shaft, providing at least one ingress point to said area of said mine shaft involved in fire, proportioning a foam concentrate into a stream of non-flammable liquid to form a stream of foam concentrate/liquid mixture, introducing a gas comprising nitrogen under pressure to said stream of foam concentrate/liquid mixture by a diffuser/dispenser apparatus to expand said foam concentrate in said stream of non-flammable liquid to form a stream of foam fire suppresant, introducing said stream containing an expanded foam fire suppressant through said at least one ingress point.

10. The method of claim 9 further including the step of drawing out at least a portion of the ambient atmosphere from said area involved in fire after it has been sealed thereby to reduce the amount of oxygen and gaseous fuel available to the fire.

11. The method of claim 9 wherein said expanded foam fire suppressant is expanded by a dispenser that proportions nitrogen containing gas into a water/foam concentrate stream thereby to initiate expansion of said foam.

12. The method of claim 11 wherein said nitrogen containing gas is proportioned to a water/foam concentrate mixture in a ratio of 2 gallons per minute of said non-flammable liquid/foam concentrate mixture to 1 cfm of said gas.

13. The method of claim 11 wherein said dispenser directs said expanded foam fire suppresant to said area of said mine shaft involved in fire through said at least one ingress point.

14. The method of claim 3 wherein said seal includes said at least one foam ingress point.

* * * * *

UNITED STATES PATENT AND TRADEMARK OFFICE

CERTIFICATE OF CORRECTION

PATENT NO. : 7,096,965 B2
APPLICATION NO. : 10/620882
DATED : August 29, 2006
INVENTOR(S) : Alden Ozment It is certified that error appears in the above-identified patent and that said Letters Patent is hereby corrected as shown below:

IN THE CLAIMS:

Col. 8, line 57: Change to read --The method of claim 9--

Signed and Sealed this

Eighteenth Day of December, 2007

JON W. DUDAS
*Director of the United States Patent and Trademark Office*